United States Patent [19]

Bozzio et al.

[11] Patent Number: 4,817,485

[45] Date of Patent: Apr. 4, 1989

[54] PEDAL OPERATED ELECTRONIC DRUM

[76] Inventors: Terry Bozzio, 10644 Wilkins Ave., Apt. No. 302, Los Angeles, Calif. 90024; Wayne Yentis, 13812 Gavina Ave., Sylmar, Calif. 91342

[21] Appl. No.: 792,042

[22] Filed: Dec. 10, 1985

[51] Int. Cl.[4] ..... G10H 3/12

[52] U.S. Cl. ..... 84/1.04; 84/DIG. 12; 84/DIG. 24

[58] Field of Search ..... 84/1.04, 1.14, DIG. 12, 84/DIG. 24

[56] References Cited

U.S. PATENT DOCUMENTS 3,008,367 11/1962 Parsons ..... 84/DIG. 12

4,479,412 10/1984 Klynas ..... 84/DIG. 24

*Primary Examiner*—Stanley J. Witkowski

*Attorney, Agent, or Firm*—Spensley, Horn, Jubas & Lubitz

[57] ABSTRACT

A pedal operated electronic drum. The electronic drum includes a pedal pivotally coupled to a base and a first striking or anvil element mounted on the base. A second striking or hammer element is operably coupled to the pedal so that depression of the pedal causes the hammer element to strike the anvil element. A transducer is acoustically coupled to the anvil element to convert impact induced vibrations in the anvil element into an electrical output signal. In one embodiment the hammer element is attached to a roller pivotally coupled to the base. A strap is wrapped about the roller and attached to the base so that depression of the pedal rotates the axle thereby causing the hammer element to strike the anvil element. In an alternative embodiment the strap is coupled to the pedal instead. Both of these embodiments may be adjusted to simulate the "feel" of a conventional pedal operated drum striking element. In yet another embodiment, the hammer and anvil elements are respectively attached to the base and pedal. A spring is disposed between the base and pedal to provide resistance and separation forces. Rapid depression of the pedal brings the hammer element into striking contact with the anvil element.

25 Claims, 3 Drawing Sheets

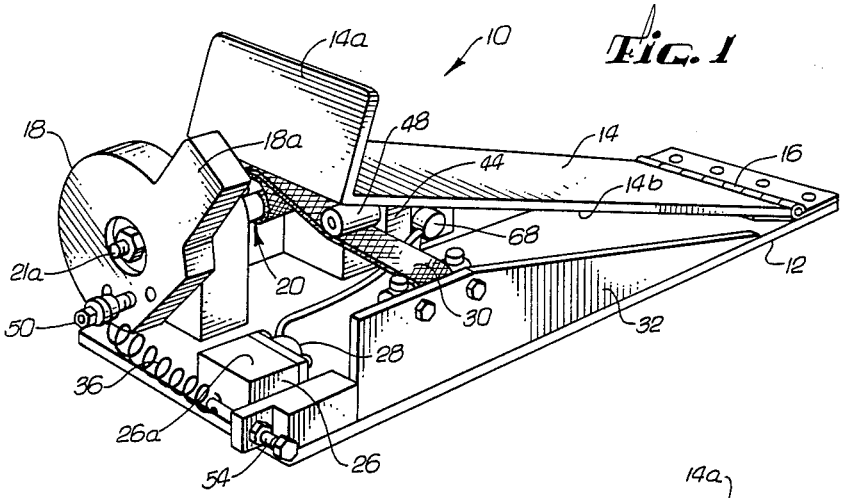
Fig. 1
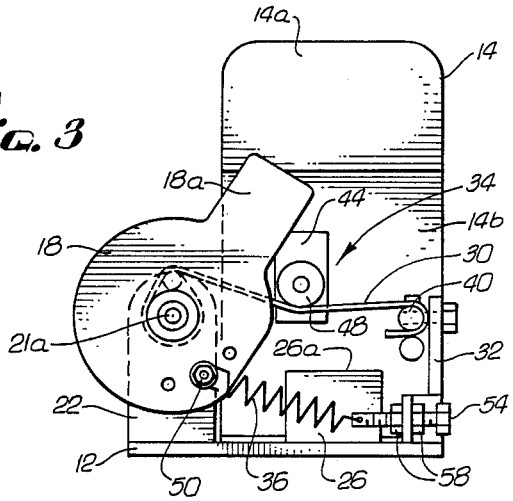
Fig. 3
Fig. 2
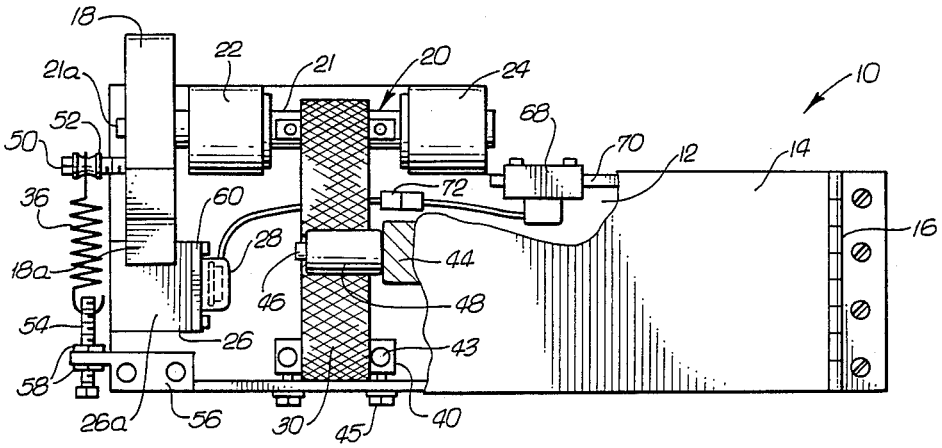

PEDAL OPERATED ELECTRONIC DRUM

BACKGROUND OF THE INVENTION

1. Field of the Invention:

The present invention concerns electronic musical instruments and more particularly electronic percussion instruments.

2. Description of the Prior Art:

Electronic musical instruments are becoming increasingly popular with modern musical groups. Such instruments typically translate a vibration in an element manipulated by a performer into an electrical output signal which can then be processed by diverse methods. Electronic instruments generally offer a rich variety of musical sounds through electronic processing with substantial versatility in individual instruments.

Electronic drums are one form of electronic musical instrument in which a performer typically hits a striking element with a drumstick to produce a vibration in the striking element which is subsequently translated into an electrical output signal. Through electronic processing, some electronic drums can be used to similate virtually any type of percussion instrument. A number of electronic drums have been developed in the past. Typically these instruments include a conventional drum structure with various types of transducer elements disposed within the drum to sense vibrations in a conventional drum diaphragm.

One type of drum commonly employed by a drummer is the pedal operated drum. In use, a conventional acoustical type drum is typically positioned with the drum diaphragm in a vertical orientation and a pedal operated striking element placed in front of the diaphragm to strike the diaphragm. Pedal operated electronic drums have generally followed the same approach, with an electronic drum simply replacing the non-electronic acoustical type drum. Thus, the electronic base drum is positioned next to and used in conjunction with a conventional pedal operated striking element.

Electronic drums employing a conventional pedal operated striking element, however, suffer from certain disadvantages. Because of the size of the electronic drum, a drummer is generally obscured from view during live performances. These drums also complicate transportation to and from performance sites. In addition, these drums typically do not provide for rapid replacement of a failed transducer element.

Thus there presently exists a need for a smaller, more compact pedal operated electronic drum which does not require the use of a conventional pedal operated striking element. Such an electronic drum, however, should be able to simulate the playing "feel" of a conventional pedal operated striking element if desired.

SUMMARY OF THE INVENTION

It is therefore a goal of the present invention to provide a small compact pedal operated electronic drum which does not require the use of a conventional pedal operated striking element. It is a further goal of the present invention to provide a pedal operated electronic drum which does not obscure the drummer during a live performance. Yet another goal is to provide a pedal operated electronic drum which simulates the playing "feel" of a conventional pedal operated striking element, yet also allows a quicker and lighter response if the drummer so desires.

These and other goals and objectives are accomplished in the present invention by providing a single pedal operated structure including a first striking or hammer element impacting a second striking or anvil element, with a transducer converting impact induced vibrations in the anvil element into an electrical output signal.

In one embodiment, a foot pedal is pivotally attached to a base plate on which the anvil element is mounted. The hammer element is attached to the end of an axle pivotally coupled to the base with a strap wrapped about the axle and connected to the base. A roller, attached to the pedal, rests on the strap so that depression of the pedal rotates the axle causing the hammer element to strike the anvil element. The transducer may be mounted on either the anvil element or the base. In an alternative embodiment, a strap is wrapped around the axle supporting the hammer element and directly attached to the pedal. In still another embodiment, the hammer and anvil elements are respectively attached to the pedal and base, and a spring is employed to provide resistance and separation forces between the pedal and base.

The novel features which are believed to be characteristic of the present invention, together with further objectives and advantages thereof, will be better understood from the following detailed description considered in connection with the accompanying drawings. It should be expressly understood, however, that the drawings are for purposes of illustration and description only and are not intended as a definition of the limits of the invention.

BRIEF DESCRIPTION OF THE DRAWINGS

FIG. 1 is a perspective view of a first embodiment of the present invention pedal operated electronic drum.

FIG. 2 is a top view of the first embodiment.

FIG. 3 is a front view of the first embodiment.

Like reference numbers in the various drawings refer to like elements.

DETAILED DESCRIPTION

Figure 4:
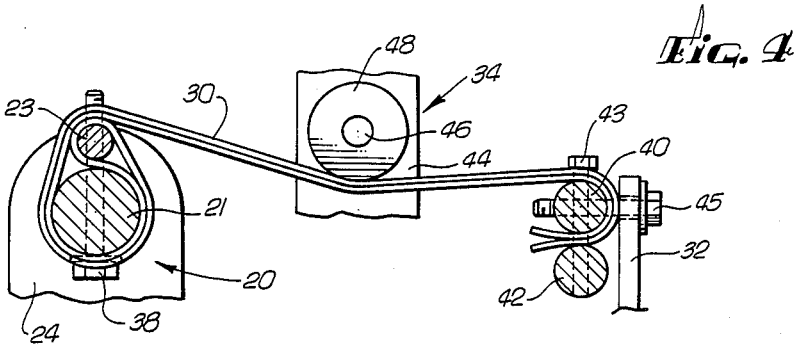
FIG. 4 is a front view illustrating an axle assembly, strap and pedal mounted roller employed in the first embodiment.
Figure 5:
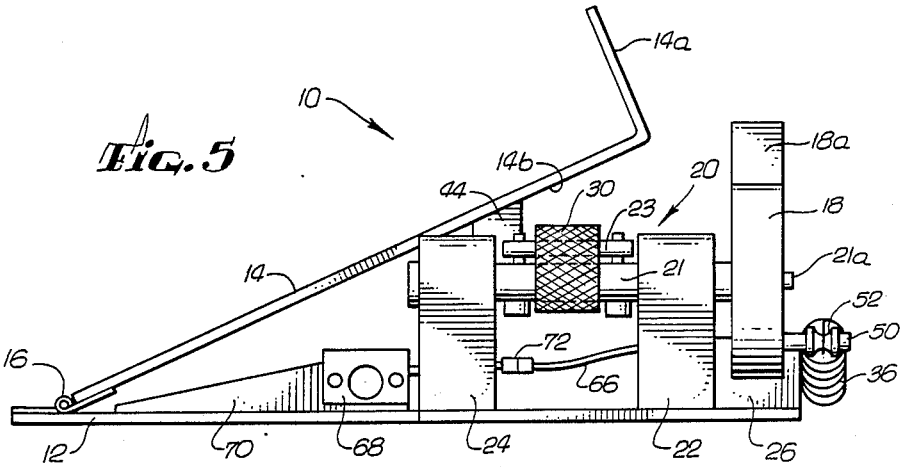
FIG. 5 is a side view of the first embodiment.

Referring to the FIGS., and more particularly to FIG. 1, there is shown a first embodiment of the present inventive pedal operated electronic drum 10. The electronic drum 10 includes a base 12 pivotally attached to a metallic foot pedal 14 by a hinge 16. A first striking or hammer element 18 is attached to one end of an axle assembly 20 rotatably mounted in supports 22, 24 attached to the base 12. A second striking or anvil element 26 is also attached to the base 12. Rotation of the axle 20 causes a projecting portion 18*a* of the hammer element 18 to strike the anvil element 26. Impact induced vibrations in the anvil element 26 are converted into an electrical output signal by a transducer 28 acoustically coupled to the anvil element 26.

The axle assembly 20 is rotatably mounted in the supports 22, 24 with a pair of roller bearings (not shown) or any other appropriate type of bearing element. The supports 22, 24 are in turn attached to the base 12 in any convenient manner such as, for example, by using adhesives, welding, or screws threaded through the base 12 into the supports 22, 24. The supports 22, 24 and axle assembly 20 are oriented so that the axis of rotation of the axle assembly 20 is parallel to the longitudinal axis of the base 12. A projecting portion 14a of the pedal 14 is provided to prevent a performer's foot from overlapping the pedal 14 and interfering with the rotation of the hammer element 18.

The axle assembly 20 and hammer element 18 are rotated by a strap 30 wrapped about the axle assembly 20 and connected to a side plate 32 attached to the base 12. The strap 30 acts in conjunction with a roller assembly 34 connected to the pedal 14. As shown in FIG. 3, depression of the pedal 14 by a performer deploys a portion of the strap 30 wrapped about the axle assembly 20 so as to rotate the axle assembly 20 and pivot the hammer element 18. A spring 36, connected to the hammer element 18 and base 12, rotates the axle assembly 20 and hammer element 12 back to a rest position when the pedal 14 is released.

As shown in FIG. 4, the axle assembly 20 is provided with a cam shape. This cam shape allows the pedal operated electric guitar 10 to simulate the "feel" of a conventional pedal operated striking element. In this illustrated embodiment, the cam shape is obtained by employing a cylindrical shaft 21 disposed through the supports 22, 24 with a small diameter rod 23 attached to the shaft 21 by screws 38. The strap 30 is attached to the axle elements 21, 23 by first wrapping a portion of the strap 30 about the rod 23, attaching the rod 23 to the shaft 21 and then wrapping the strap 30 about both the shaft 21 and rod 23. Both ends of the strap 30 are subsequently secured to the side plate 32. It should be noted that a single shaft having a cam shaped portion could be used in place of the axle elements 21, 23.

Two bars 40, 42 are used to secure the ends of the strap 30 to the side plate 32. The bars 40, 42 are connected together by screws 44 with the ends of the strap 30 pinched between the bars 40, 42. The bar 40 is in turn attached to the side plate 32 by screws 46. Obviously, numerous other methods could be used to adjustably secure the strap 30. The length of strap 30 extending from the bars 40, 42 to the axle assembly 20 will determine the rotational orientation of the rest position for the hammer element 18 and axle assembly 20. Due to the cam shape of the axle assembly 20, the rotational orientation of the rest position will determine the amount of force required by a performed to start rotation of the hammer element 18. By using an adjustable strap length, this starting force can be varied to an individual performer's preference.

The pedal 14 is supported on the strap 30 by a roller assembly 34 resting on the strap 30. This roller assembly 34 includes a block 44 attached to the underside 14b of the foot pedal 14 and a shaft 46 extending from the block 44. A cylindrical element 48 is rotatably mounted on the shaft 46.

As shown in FIGS. 1, 3 the hammer element 18 has a generally flat circular configuration (disc-shaped) with a projecting portion **18*a* provided for striking the anvil element 26 upon rotation of the axle assembly 20. The hammer element 18 is attached to an end 21*a* of the shaft 21 projecting through the support 22. The hammer element 18 may be secured to the shaft 21 in any convenient manner. In this illustrated embodiment, the shaft end 21*a* is configured as a threaded screw which projects through an aperture in the hammer element 18. If desired, the shaft end 21*a* and the aperture of the hammer element 18 may be configured with corresponding non-circular geometries to avoid slippage of the hammer element 18 with respect to the shaft 21**.

The anvil element 26 may have any convenient configuration, preferably providing a generally flat surface **26*a* to be struck by the projecting portion 18*a* of the hammer 18, and may be attached to the base 12 in any convenient manner. Both the hammer element 18 and anvil element 26 may be composed of metal. Other materials however, should provide a satisfactory acoustic interaction. For example, it should be possible to fabricate the hammer element 18** out of plastic, such as nylon. As is well known in the art, nylon is a generic term for a long-chain synthetic polymeric amide.

As mentioned above, a spring 36 is used in the preferred embodiment to return the hammer element 18 and axle assembly 20 to a preselected rest position. The strap 30 is sufficient to prevent return rotation by spring 36 of the hammer element 18 and axle assembly 20 past the rest position. The spring 36 is secured at one end by a screw 50 threaded into a hole in the hammer element 18. A cylindrical roller 52 may be disposed about the screw 50 to reduce friction wear between the spring 36 and screw 50. The other end of the spring 36 is secured to the base 12 by a screw 54 threaded through a block 56. The block 56 is mounted onto the base 12 and may be attached to the base 12 in any convenient manner. Tension on the spring 36 may be varied by altering the length of the screw 54 threaded through the block 56. Lock nuts 58 are provided to secure the screw 54 with respect to the block 56.

The tension on spring 36 may also be varied by providing a plurality of threaded holes in the hammer element 18 for receiving the screw 50 at varying radial distances from the center of the hammer element 18. Variations in the tension of the spring 36 and the location of the screw 50 will affect the "responsiveness" and "feel" of the electric drum 10 by altering the force required to depress the pedal 14 and further alter the response time in which the hammer element 18 returns to a rest position after release of the pedal 14. By varying the tension of spring 30 and the location of screw 50 this embodiment of the pedal operated electronic drum 10 can be adjusted to simulate the "feel" and "responsiveness" of a conventional pedal operated striking element. If desired, however, a lighter depression force and quicker "responsiveness" can be obtained.

A satisfactory conversion of impact induced vibrations in the anvil element 26 into electrical output signals is achieved by using transducers 28 incorporating a piezoelectric material. Piezoelectric transducers are well known in the art and are available from a number of sources, such as, for example, Kyocera International, Inc. of San Diego, Calif. The transducer 28 may be attached either to the anvil element 28 as shown in FIGS. 1, 2 or, alternatively, attached to the base 12 out of direct line with the striking path of the hammer element 18.

Preferrably, the transducer 28 is detachably mounted to provide for rapid replacement if the transducer 28 fails. The transducer 28 may be attached to a mounting plate 60 which can then be secured to the anvil element 26 or base 12 by screws, VELCRO, or any suitable re-attachable adhesive. In the embodiment illustrated in FIGS. 1–5, the mounting plate 60 is secured to the anvil element 26 by screws.

Figure 10:
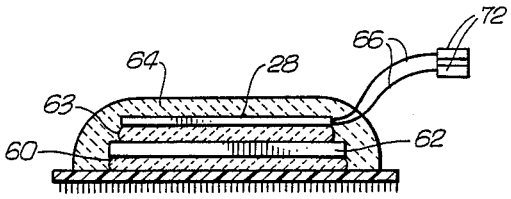
FIG. 10 is a side view detailing the attachment structure for a transducer assembly employed in the present invention.

FIG. 10 shows the manner in which the transducer 28 is attached to the mounting plate 60. A slightly resilient element 62 is first adhesively bonded to the plate 60 with an adhesive having a rubbery character when cured. Such adhesives are well known in the art, one example being a room temperature vulcanizing adhesive. The element 62 may be composed of one of a number of slightly resilient materials such as, for example, LEXAN. As is well known in the art, LEXAN is a trademarked thermoplastic polycarbonate condensation product of bisphenol-A and phosgene. The transducer 28 is then bonded to the resilient element 62 with the same type of adhesive used in securing the resilient element 62 and the entire transducer 28 encapsulated in a coating 64 of the same adhesive. It has been found that bonding the transducer 28 to the mounting plate 60 with a resilient element 62 is useful to partially shield the transducer 28 from vibrational shock encountered when the hammer element 18 strikes the anvil element 26 during playing. Use of a rubbery adhesive provides further shock attenuation. The adhesive coating 64 encapsulating the transducer 28 protects leads 66 extending from the transducer 28 from dislodging due to playing shocks.

The transducer leads 66 are attached to a conventional electrical connector 68 mounted in a side plate 70 attached to the base 12 opposite side plate 32. The electrical connector 68 provides a convenient interface between the electronic drum 10 and wires (not shown) leading to some appropriate type of electronic signal processing equipment. If desired, a further quick-disconnect type electrical connector 72 (shown in FIGS. 2, 5) may be provided between the transducer leads 66 and the electrical connector 68 to facilitate rapid removal of the tranducer 28.

Figure 6:
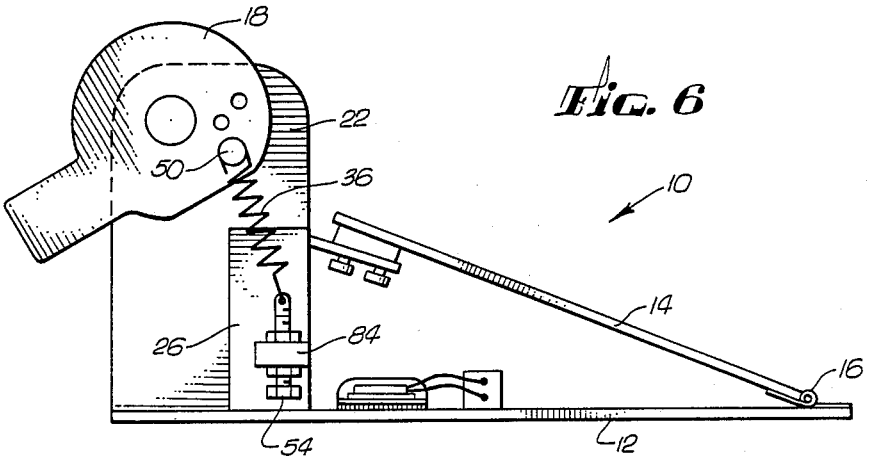
FIG. 6 is a side view of a second embodiment of the present invention pedal operated electronic drum.
Figure 7:
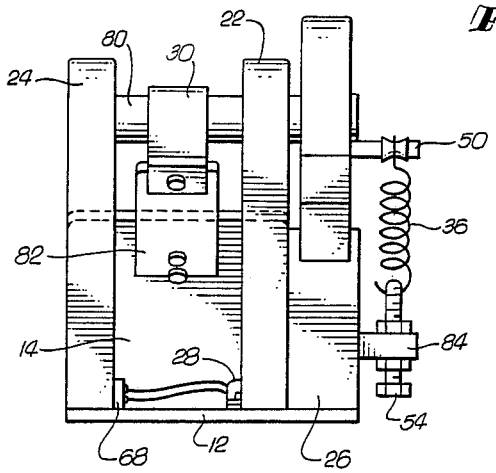
FIG. 7 is a front view of the second embodiment.
Figure 8:
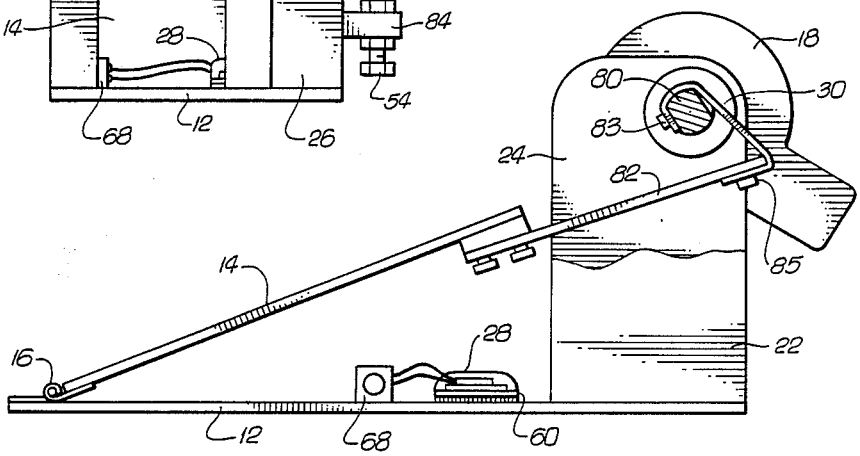
FIG. 8 is an opposite side view of the second embodiment.

FIGS. 6–8 illustrate a second embodiment of the present inventive pedal operated electronic drum 10. In this embodiment the base 12 and pedal 14 are again pivotally connected by a hinge 16 with a hammer element 18 striking an anvil element 26. In this embodiment, however, the hammer element 18 is attached to a cam shaped axle 80 having a rotational axis parallel to the pivotal axis of the pedal 14. The cam 80 is rotatably mounted in the two supports 22, 24 and the hammer element 18 attached to one end of the cam 80 in the same manner as the attachment between the hammer element 18 and the axle assembly 20 discussed above.

As shown in FIG. 8, one end of the strap 30 is attached to an extension element 82 which is adjustably connected to the pedal 14. The other end of the strap 30 is attached to and partially wrapped about the cam 80. The strap 30 may be secured to the cam 80 in any convenient manner such as, for example, with a screw 83 threaded into the cam 80. Similarly a screw 85 may be disposed through the strap 30 and threaded into the extension element 82. Adjustments in the length of the extension element 82 projecting past the pedal 14 provides variations in the force necessary to depress the pedal 14 according to a performer's preference. It should be noted that while this embodiment is shown employing a cam 80, the axle assembly 20 discussed above could also be used instead.

The spring 36 is again used to return the hammer element 18 and cam 80 to a rest position. As shown in FIG. 6, one end of the spring 36 is attached to a screw 50 threaded into one of a plurality of holes in the hammer element 18. The other end of the spring 36 is secured by the screw 54 threaded through a block 84 attached to the anvil element 26. As shown in FIG. 7, the anvil element 26 is mounted on the base 12 adjacent the cam support 22. The anvil element 26 could also be mounted directly onto the support 22. Variations in the tension of spring 36 and the location of screw 50 also affect the "responsiveness" and "feel" of this embodiment of the pedal operated electronic drum 10 by altering the force required to depress the pedal 14 and by altering the response time of the hammer element 18 returning to a rest position rotational orientation.

As in the first embodiment, the transducer 28 and related elements are mounted on a plate 60 as shown in FIG. 10. As shown in FIGS. 6, 8, the mounting plate 60 may be detachably mounted onto the base 12 at any convenient location.

Figure 9:
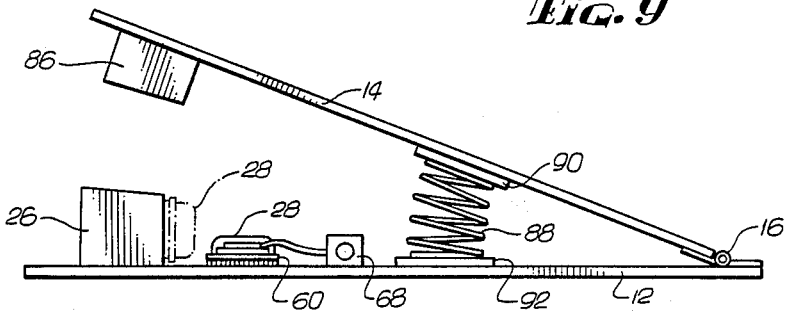
FIG. 9 is a side view of a third embodiment of the present inventive pedal operated electronic drum.

A third embodiment of the present inventive electronic drum 10 is shown in FIG. 9. This embodiment, while not simulating the "feel" of a conventional pedal operated striking element, can be played much faster than conventional pedal operated striking elements.

The base 12 and foot pedal 14 are again pivotally connected by a hinge 16 with an anvil element 26 attached to the base 12. A differently configured hammer element 86, however, is directly attached to the pedal 14. While the anvil element 26 and hammer element 86 are both shown in FIG. 9 as having a generally rectangular configuration, other shapes could be employed as well. Rapid displacement of the pedal 14 by a performer brings the hammer element 18 into striking contact with the anvil element 26.

The transducer element 28 and the related mounting assembly discussed above and shown in FIG. 10 is also employed in this embodiment. The transducer 28 and mounting plate 60 can either be mounted onto the base 12 or, alternatively, mounted onto the anvil element 26. Preferably, this mounting is detachable for rapid replacement of the transducer 28 if it fails.

In this illustrated embodiment, a spring 88 is disposed between the base 12 and pedal 14 to provide a resistance force and to separate the base and pedal. Retaining cups 90, 92 are respectively attached to the base 12 and pedal 14 to secure the position of the spring 88. A resilient element (not shown) is disposed in the retaining cup 92 to prevent the transducer 28 from picking up acoustical noise associated with movement of the spring within the retaining cup 92.

The retaining cups 90, 92 may be respectively attached to the base 12 and pedal 14 by any convenient manner. In this illustrated embodiment, screws are threaded into the base 12 and pedal 14. By providing a plurality of threaded holes in the base 12 and pedal 14, variations in the force required to depress the pedal 14 and variations in the travel distance of the pedal 14 can be adjusted to an individual performer's preference. Where variation in the pedal depression force is not required, the spring 88 and retaining cups 90, 92 could be replaced by a conventional type of hinge 16 incorporating its own spring element.

It will, of course, be understood that modifications of the present inventive pedal operated electronic drum and its various aspects will be apparent to those skilled in the art, some being apparent only after study and other merely matters of routine mechanical design. For example, the transducer 28 and resilient element 62 could be adhesively bonded directly to the anvil element 26 or base 12 instead of bonding onto a detachable plate 60. Accordingly, the scope of the present invention should not be limited by the particular embodiments herein described, but should be defined only by the appended claims and equivalents thereof.

What is claimed is:

1. A pedal operated electronic percussion instrument comprising:

a base;

a pedal pivotally connected to the base;

an anvil element attached to the base, the anvil element having a first striking surface and a first transducer coupling surface, wherein the transducer coupling surface is positioned and oriented away from direct parallel overlap with the first striking surface;

a movable striking element for striking the first striking surface of the anvil element, the striking element having a second striking surface which is engageable with the first striking surface of the anvil element;

actuating means, connected to the base of the striking element, for causing the second striking surface to impact the first striking surface of the anvil element when the pedal is depressed thereby inducing vibrations in the anvil element and for returning the pedal and striking element to respective first and second rest positions when the pedal is released; and transducer means, acoustically coupled to the transducer coupling surface of the anvil element, for converting impact induced vibrations in the anvil element into an electrical output signal.

2. The pedal operated electronic percussion instrument of claim 1 wherein said transducer means comprises:

a mounting plate adapted for attachment to the transducer coupling surface of the anvil element;

a resilient element, made of a slightly resilient material, which is bonded to the mounting plate with an adhesive having a resiliently deformable character when cured; and a piezoelectric transducer adhesively bonded to the resilient element with the same adhesive and further encapsulated in a coating of the adhesive.

3. The pedal operated electronic percussion instrument of claim 1 wherein the striking and anvil elements are composed of steel.

4. The pedal operated electronic percussion instrument of claim 1 wherein the striking and anvil elements are composed of aluminum.

5. The pedal operated electronic percussion instrument of claim 1 wherein the actuating means comprises:

a roller, rotatably mounted on the base, the roller being generally disc shaped and having a central axis of rotation, wherein the striking element is attached to one end of the roller, the end being spaced away from the central axis of rotation;

a strap of predetermined length attached to the roller and to the base, wherein at least a portion of the strap length extends in a generally linear manner between the roller and the base, the strap being arranged such that tension applied to its extending portion will create a force which will urge the roller rotatably;

a spring connected to the base and the roller for applying tension to the strap; and an engagement element attached to the pedal and contacting the extending portion of the strap so that depression of the pedal rotates the roller thereby causing the striking elements to strike the anvil element and wherein the spring rotates the roller to a predetermined third rest position on release of the pedal.

6. The pedal operated electronic percussion instrument of claim 5 wherein said strap is attached to the roller through an eccentrically shaped cam, the eccentric shape of the cam creating a variable moment arm between the strap and roller which changes the force applied to the roller by the strap substantially for a rotation of the roller which is less than 360 degrees.

7. The pedal operated electronic percussion instrument of claim 5 further comprising spring adjustment means for adjusting tension in the spring when the pedal is released to the first rest position and strap adjusting means, attached to the strap, for adjusting the travel distance of the pedal, the travel distance being the distance from the first rest position where the pedal is undepressed to a first striking position of the pedal where the first and second striking surfaces meet.

8. The pedal operated electronic percussion instrument of claim 1 wherein the actuating means comprises:

a roller rotatably mounted on the base, the roller being generally disc-shaped and having a central axis of rotation, wherein the striking element is attached to one end of the roller, the end being spaced away from the central axis of rotation in such a manner that rotation of the roller will cause the striking element to strike the anvil element;

a strap connected to the roller and the pedal so that depression of the pedal rotates the roller thereby causing the striking element to strike the anvil element; and a spring connected to the base and the striking element so as to rotate the roller to a predetermined third rest position on the release of the pedal.

9. The pedal operated electronic percussion instrument of claim 8 wherein said roller includes a cam shaped surface which is contacted by a portion of the strap.

10. The pedal operated electronic percussion instrument of claim 8 further comprising tension adjusting means for adjusting the spring tension when the pedal is undepressed in the first rest position and distance adjusting means, attached to the strap, for adjusting the travel distance of the pedal when depressed to move from the first rest position to a second pedal position where the striking element strikes the anvil element.

11. The pedal operated electronic percussion instrument of claim 1 wherein the striking and anvil elements are made of metal.

12. The pedal operated electronic percussion instrument of claim 1 wherein the striking element is made of a long-chain synthetic polymeric amide.

13. The pedal operated electronic percussion instrument of claim 2 wherein the mounting plate is detachably fastened to the transducer coupling surface such that the transducer means can be quickly removed and replaced in the event of failure.

14. The pedal operated electronic percussion instrument comprising:

a base;
a pedal pivotally coupled to the base;
an anvil element connected to the base;
a roller pivotally coupled to the base;
a striking element, for striking the anvil element, connected to one end of the roller;
a strap connected to the base and the roller;
a spring connected to the base and the striking element;
an engagement element attached to the pedal and contacting the strap so that depression of the pedal rotates the roller thereby causing the striking element to strike the anvil element, along a predetermined striking direction, wherein the spring rotates the striking element and roller to a rest position on release of the pedal; and
transducer means, acoustically coupled to the anvil element, for converting impact induced vibrations in the anvil element into an electrical output signal, wherein the transducer means is positioned out of alignment with the predetermined striking direction of the striking element.

15. The pedal operated electronic percussion instrument of claim 14 wherein said roller is disc-shaped.

16. The pedal operated electronic percussion instrument of claim 14 further comprising means, attached to the strap, for adjusting the spring tension and means for varying the travel distance of the foot pedal when depressed to move the roller from the rest position to a striking position.

17. The pedal operated electronic percussion instrument of claim 14 wherein said transducer means comprises:
a mounting plate;
a resilient element, made of a slightly resilient material, bonded to the mounting plate with an adhesive which has a resiliently deformable character when cured; and
a piezoelectric transducer, adhesively bonded to the resilient element with the same adhesive and further encapsulated in a coating of the adhesive.

18. A pedal operated electronic percussion instrument comprising:
a base;
a pedal pivotally connected to the base;
an anvil element connected to the base;
a striking element, attached to the pedal, for striking an impact point on the anvil element with a directed impact force when the pedal is depressed to thereby induce vibrations in the anvil element;
a spring coupled to the pedal and disposed to return the pedal to a rest position; and
transducer means, acoustically coupled to the anvil element, for converting impact induced vibrations in the anvil element into an electrical output signal, the transducer means being positioned out of direct alignment with the impact force generated by the striking element.

19. The pedal operated electronic percussion instrument of claim 18 further comprising a tension adjusting means, interposed between the spring and the base, for adjusting the tension of the spring.

20. A miniaturized, pedal operated percussion instrument which simulates the operational feel of a larger pedal operated percussion instrument, where the larger instrument is characterized by an elongated drum stick of a given length that is pedal actuated to swing and strike a drum diaphragm, the miniaturized instrument comprising:
a base;
a pedal, pivotally mounted on the base;
an inertia simulating mass, of a substantially disc-like shape, which is rotatably mounted on the base and operationally coupled to the pedal such that the mass will rotate when the pedal is actuated, the mass including a projected portion for impacting a striking surface;
a metal anvil having a striking surface which is positioned to be struck by the projected portion along a predetermined striking direction when the mass is rotated from a preselected rest position to a preselected striking position, the anvil further having a transducer coupling surface; and
a piezoelectric transducer which is acoustically coupled to the transducer coupling surface of the anvil for converting impact induced vibrations in the anvil into electrical signals, wherein the transducer coulpling surface is connected to a first portion of the base and the piezoelectric transducer is connected to a second portion of the base such that impact induced vibrations in the anvil are coupled to the transducer through the base, and wherein the transducer coupling surface is not parallel to the striking surface.

21. The instrument of claim 20 wherein the transducer coupling surface is at right angles to the striking surface.

22. An electronic percussion instrument comprising:
a base;
a pedal, pivotally attached to the base;
a movable hammer element, actuatably coupled to the pedal;
an anvil element, made of a material which vibrates when struck, the anvil element having a striking surface disposed in a first position for engagement with the hammer element when the pedal is actuated and a transducer coupling surface disposed at a second position for acoustically coupling impact induced vibrations in the anvil element to a transducer; and
a piezoelectric transducer which is acoustically coupled to the transducer coupling surface, wherein the piezoelectric transducer is positioned away from any substantially direct, parallel overlap with the striking surface of the anvil.

23. The electronic percussion instrument of claim 22 wherein a slightly resilient element is interposed between the piezoelectric transducer and the transducer coupling surface to partially shield the piezoelectric transducer from vibrational shock.

24. The electronic percussion instrument of claim 23 wherein the resilient element is composed of a polycarbonate condensation product of bisphenol-A phosgene.

25. The electronic percussion instrument of claim 22 wherein the piezoelectric transducer has a thin plate-like shape of which only one side is acoustically coupled to the electronic percussion instrument.

* * * * *